United States Patent [19]

Sato

[11] Patent Number: 4,612,729

[45] Date of Patent: Sep. 23, 1986

[54] SLIDE DOOR OPENING/CLOSING APPARATUS FOR AUTOMOTIVE VEHICLE

[75] Inventor: Yoshimi Sato, Yokohama, Japan

[73] Assignee: Nissan Motor Co., Ltd., Yokohama, Japan

[21] Appl. No.: 595,539

[22] Filed: Mar. 30, 1984

[30] Foreign Application Priority Data

Apr. 14, 1983 [JP] Japan ..... 58-66159

[51] Int. Cl.[4] ..... E05F 11/34; E05F 15/00

[52] U.S. Cl. ..... 49/362; 49/280; 49/358; 70/257

[58] Field of Search ..... 49/362, 358, 280, 279, 49/334; 296/146, 155; 70/237, 257; 200/61.64, 61.66, 61.71

[56] References Cited

U.S. PATENT DOCUMENTS

| | | | |
|---|---|---|---|
| 1,699,398 | 1/1929 | Lach | 70/257 X |
| 2,056,174 | 10/1936 | Earhuff et al. | 49/362 X |
| 3,000,204 | 9/1961 | De Vito | 70/264 |
| 3,022,108 | 2/1962 | Cooley | 49/358 X |
| 3,331,428 | 7/1967 | Ford | 49/358 X |
| 3,398,484 | 8/1968 | Katsumura et al. | 49/358 X |
| 3,632,913 | 1/1972 | Hukuta | 200/61.66 X |
| 3,652,124 | 3/1972 | Tronville | 296/146 |
| 3,653,154 | 4/1972 | Hayday | 49/358 X |
| 3,745,705 | 7/1973 | Reddy | 49/362 X |
| 3,893,260 | 7/1975 | Cadiou | 49/362 |
| 4,121,382 | 10/1978 | Dietrich et al. | 49/334 |
| 4,170,847 | 10/1979 | Pickles | 49/362 X |

FOREIGN PATENT DOCUMENTS

| | | |
|---|---|---|
| 1800784 | 6/1970 | Fed. Rep. of Germany . |
| 1321582 | 2/1963 | France . |
| 2469309 | 11/1979 | France . |
| 8101587 | 6/1981 | PCT Int'l Appl. . |

*Primary Examiner*—Philip C. Kannan

*Attorney, Agent, or Firm*—Schwartz, Jeffery, Schwaab, Mack, Blumenthal & Evans

[57] ABSTRACT

When a driver inserts a key into a cylindrical lock-type outside door switch and rotates it clockwise or counter-clockwise, a slide door for an automotive vehicle is opened or closed automatically by motor power from the outside of the vehicle. Additionally, when the driver inserts the key into the outside door switch, and rotates it to an open position, the slide door is unlocked automatically before being opened; when the driver extracts the key from the outside door switch, the closed slide door is locked automatically. A motor is mounted on the slide door and a power supply is applied to the motor by means of a current collector. A pinion and rack are also mounted on the slide door to open or close the door. Such structure allows the slide door to be opened or closed manually or automatically.

10 Claims, 9 Drawing Figures

37 (OUTSIDE CLOSE)
36 (OUTSIDE OPEN)
40 (INSIDE)
41 (INSIDE)
42 (INSIDE LOCK)
33 (OUTSIDE LOCK)
(LMT)
(LMT)
N
O
N
C
U
N
L
U
L
U
L
U

SLIDE DOOR OPENING/CLOSING APPARATUS FOR AUTOMOTIVE VEHICLE

BACKGROUND OF THE INVENTION

1. Field of the Invention

The present invention relates generally to a slide door opening/closing apparatus for opening or closing a slide door of an automotive vehicle by means of a motor when a door opening/closing switch is operated.

2. Description of Prior Art

Conventionally, in automotive vehicles provided with slide doors, motor-powered slide-door opening/-closing apparatus are equipped for facilitating loading or unloading of baggage and for passenger entry and exit. In such automotive vehicles provided with the motor-powered slide door opening/closing apparatus, however, the slide door opening/closing switch is arranged only within the passenger compartment. Therefore, in order to open or close the slide door on the outside of the vehicle, the driver must open or close the slide door manually, thus resulting in inconvenience.

SUMMARY OF THE INVENTION

With these problems in mind, therefore, it is the primary object of the present invention to provide a slide door opening/closing apparatus for an automotive vehicle by which the slide door can be opened or closed automatically by the power of a motor when the driver operates an inside door switch disposed within the passenger compartment or an outside door switch disposed at an outside position of the vehicle body.

It is another object of the present invention to provide a slide door opening/closing apparatus by which the slide door can be locked automatically after the driver has operated the outside door switch.

It is a further object of the present invention to provide a slide door opening/closing apparatus provided with a slide door driving mechanism by which the slide door can be manually opened or closed.

To achieve the above-mentioned objects, the slide-door opening/closing apparatus for an automotive vehicle according to the present invention comprises a slide door driving mechanism driven by a motor for opening or closing a slide door, an inside door switch disposed within a passenger compartment for driving the slide door driving mechanism in either direction, and a key-operated cylindrical lock-type outside door switch disposed in an outside position of the vehicle, similarly for driving the slide door driving mechanism in either direction.

The key-operated cylindrical lock-type outside switch is made up of three sub-switches including a door opening switch, a door closing switch, and a door locking switch. Therefore, in order to open or close the slide door from the outside of the vehicle, the driver first inserts a key into the cylindrical lock-type outside switch and then rotates the key clockwise or counter-cockwise. Additionally, when the key is extracted from the outside switch after the slide door has been closed, the slide door is locked automatically.

Further, the slide door driving mechanism is roughly made up of a guide rail fixed to the vehicle body, a roller fixed to the slide door, a motor fixed to the slide door, a reduction gear mechanism connected to the motor, a pinion gear geared with the reduction gear mechanism, a rack fixed to the rail, and a current collector for applying power supply voltage to the motor moving together with the slide door.

BRIEF DESCRIPTION OF THE DRAWINGS

The features and advantages of the slide-door opening/closing apparatus according to the present invention will be more clearly appreciated from the following description taken in conjunction with the accompanying drawings in which like reference numerals designate corresponding elements throughout the figures thereof and in which.

DETAILED DESCRIPTION OF THE PREFERRED EMBODIMENTS

Figure 1:
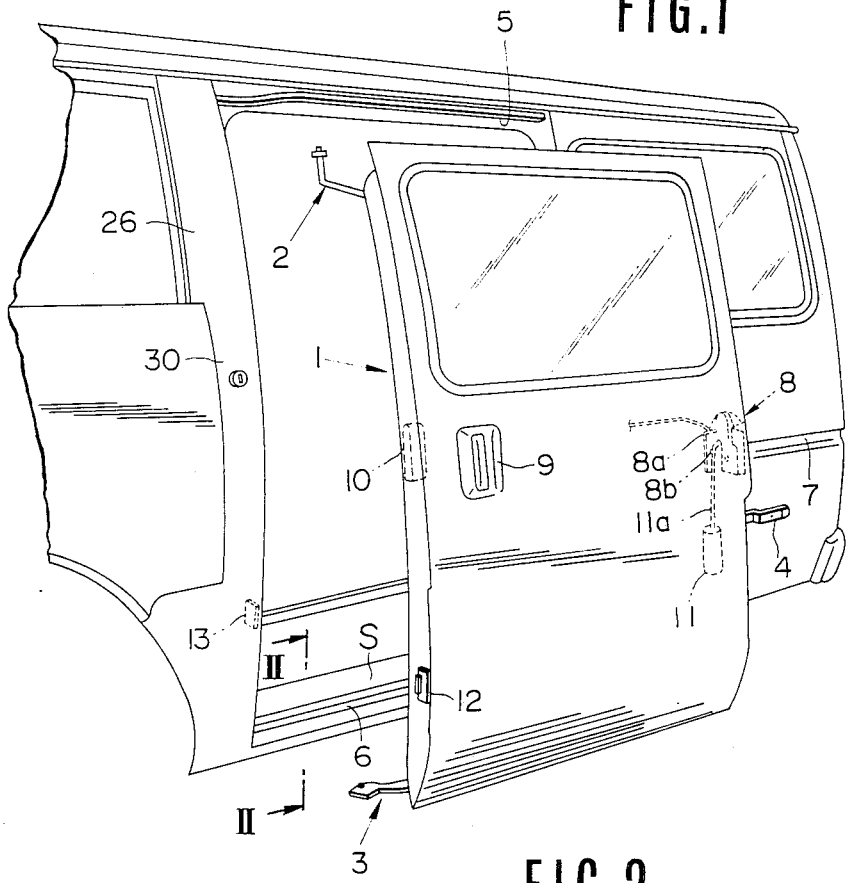
FIG. 1 is a perspective view of a part of an automotive vehicle, in which a slide door is illustrated being separated from the vehicle body.

With reference to FIG. 1, the structure of a slide door wil first be described briefly hereinbelow. A slide door 1 is supported, on a vehicle body at three points, by an upper roller 2 disposed at the front upper portion of the slide door 1, a lower roller 3 disposed at the front lower portion of the slide door and a waist link 4 disposed at the rear middle portion of the slide door. The upper roller 2 is engaged with an upper guide rail 5 attached to the upper end of a door opening portion of the vehicle body; the lower roller 3 is engaged with a lower guide rail 6 attached to the lower end of the door opening portion of the vehicle body; the waist link 4 is engaged with a waist rail 7 attached to the middle portion of a vehicle body outer panel, respectively, so that the slide door 1 can be slidably moved along these guide rails to and fro.

The slide door 1 is provided with a door locking/unlocking device 8 having a first door unlock lever **8*a* and a second door unlock lever 8*b*. The first lever 8*a* is actuated when an outside door handle 9 is operated; the second level 8*b* is actuated when an inside door handle 10 is operated. When these levers 8*a* and 8*b*** are operated, a latch mechanism (not shown) engaged with or disengaged from a door striker (not shown) fixed to the vehicle body can be moved to a door opening position (unlatch position).

The second lever 8*b* is linked to an actuator rod 11*a* of an actuator 11 disposed within the slide door 1. The actuator 11 is an electromagnetic actuator, for instance. The actuator 11 is energized only when the slide door 1 is perfectly closed. In more detail, a movable contact 12 is so disposed as to project from the front end surface of the slide door 1 and a fixed contact 13 is disposed at the front end of the door opening portion of the vehicle body. Therefore, the movable contact 12 is only brought into contact with the fixed contact 13 when the door is completely closed. Furthermore, since the fixed contact 13 is connected to one terminal of a power supply, when the slide door 1 is completely closed, a power supply voltage is supplied to the actuator 11 to lock the slide door 1.

As described above, the slide door 1 can be unlocked manually when the driver operates either the outside door handle 9 or the inside door handle 10, or automatically when the driver depresses a door unlocking switch (described later). In this specification, "automatic" or "automatically" means that the slide door is opened/closed or locked/unlocked by the power of a motor; that is, a slide door opening/closing device (described later) or the slide door locking/unlocking device 8 is driven by a motor.

The door locking/unlocking device 8 used with the embodiment of the present invention is of an override mechanism type, by which the door is first unlocked and then opened or the door is first closed and then locked. Therefore, in order to open the slide door 1, the device 8 is first allowed to be unlocked and then a door opening/closing device is actuated to open the door. In order to close the door, the door opening/closing device is first actuated to close the door and then the device 8 is allowed to be locked. When locked, a latch of the device 8 is engaged with a stricker disposed on the vehicle body side. The above-mentioned door lock-/unlock operations are performed by the electromagnetic actuator 11.

Figure 2:
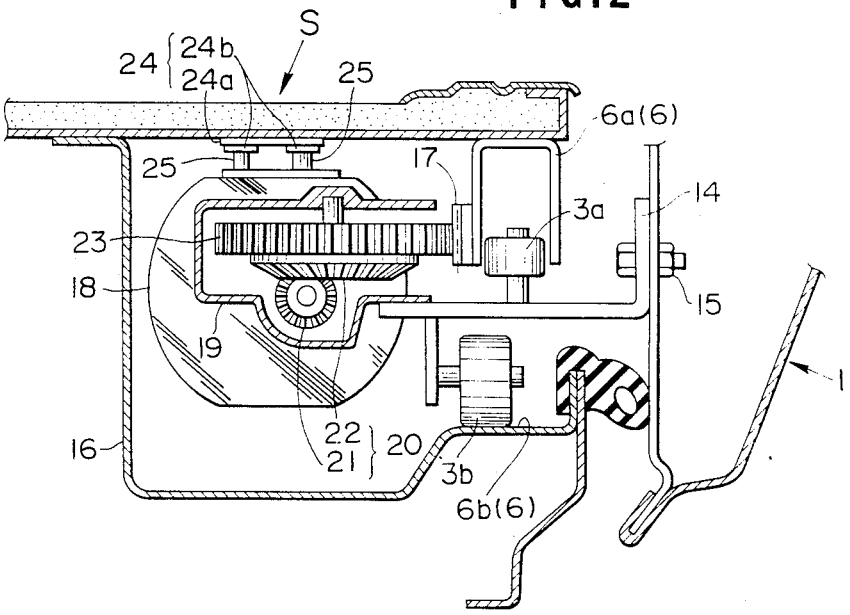
FIG. 2 is a cross-sectional view taken along the line II—II shown in FIG. 1, which illustrates an embodiment of the slide door driving mechanism incorporated in the slide dor opening/closing apparatus according to the present invention.
Figure 3:
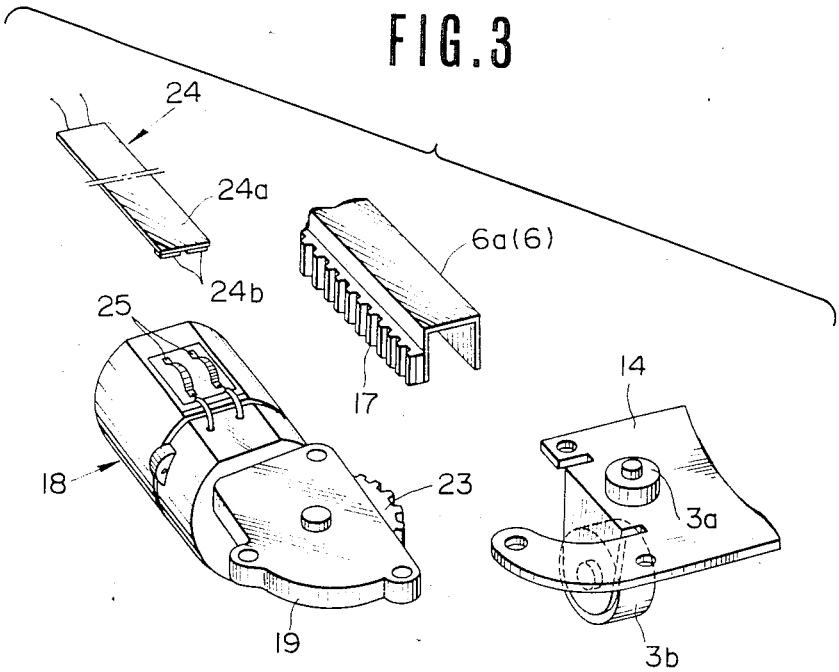
FIG. 3 is an enlarged view of some of the essential parts such as the current collector, the motor, the reduction gear mechanism, the rack, the bracket, etc., which are used for the slide door mechanism shown in FIG. 2.
Figure 4:
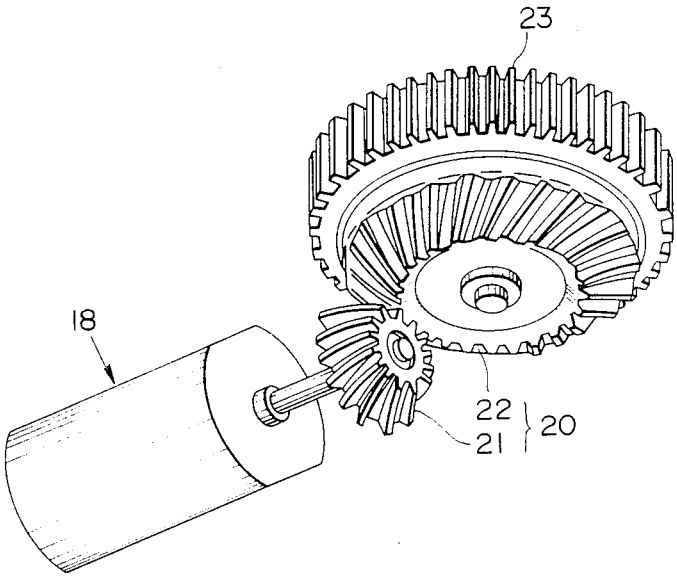
FIG. 4 is a perspective view of the motor, reduction gear and pinion.

With reference to FIGS. 2, 3 and 4, an automatic slide door opening/closing device according to the present invention will be described hereinbelow.

The lower roller 3 is made up of a first horizontal roller 3*a* and a second vertical roller 3*b*. The first roller 3*a* is rotatably supported on the upper surface of a bracket 14 fixed to the inner panel of the slide door 1 by the use of bolts and nuts 15; the second roller 3*b* is also rotatably supported on the lower surface of the same bracket 14. The first roller 3*a* is engaged with the reverse U-shaped lower guide rail 6*a* fixed under the step portion S formed at the lower end of the door opening portion of the vehicle body in order to restrict the slide door vibrations in the lateral direction of the vehicle. The second roller 3*b* is mounted on a rail portion 6*b* of a reinforcement member 16 disposed under the above-mentioned step portion S, extending in the longitudinal direction of the vehicle, in order to support the weight of the slide door 1.

A rack 17 is fixedly disposed in the longitudinal direction of the vehicle body on and along the inside outer surface of the lower guide rail 6*a* so as to face the longitudinal center line of the vehicle body.

A motor 18 is fixed to one end portion of the bracket 14 via a gear housing 19, as depicted in FIG. 3. Within the gear housing 19, a reduction gear mechanism 20 including a drive gear 21 fixed to the drive shaft of the motor 18 and an idle gear 22 meshed with the drive gear 21 is housed. This idle gear 22 is formed integrally with a pinion gear 23. The pinion gear 23 is meshed with the rack 17 fixed to the inside outer surface of the lower guide rail 6*a*.

As described above, since the motor 18 is fixed to the bracket 14, which is fixed to the slide door 1, the motor 18 and the reduction gear mechanism 20 including pinion gear 23 move along the rack 17 together with the slide door 1.

Therefore, a current collector 24 for the motor 18 is laid under the step portion S along the movement course of the motor 18. This current collector 24 includes a band-shaped base plate 24*a* made of an insulating material and a pair of conductive rails 24*b* attached to the one surface of the base plate 24*a*. On the other hand, a pair of collector contact springs 25 are disposed on the upper portion of the motor 18 in such a way as to be slidable in pressure contact with the conductive rails 24*b*, respectively, when the motor 18 moves in the longitudinal direction of the vehicle together with the slide door 1.

Therefore, in the door opening/closing device described above, when the motor 18 is driven and therefore the pinion 23 rotates either clockwise or counterclockwise, the slide door 1 can be moved by the motor power to and fro together with the motor 18 along the rack fixed to the vehicle body. The motor stops driving the slide door 1 when either the door-close limit switch or the door-open limit switch (described later) is opened. The door-close limit switch is opened (turned off) when the slide door is fully closed and the door-open limit switch is opened (turned off) when the slide door is fully opened.

Further, it is also possible to freely open or close the slide door 1 manually, because the pinion 23 rotates on and along the rack 17 freely when the slide door 1 is being opened or closed. In this case, the reduction gear mechanism 20 and the motor 18 are driven manually together with the pinion 23. However, when it is desired to reduce the power to open or close the slide door 1, it is preferable to dispose an electromagnetic clutch between the idle gear 22 and the pinion gear 23. In this case, the idle gear 22 is of course formed separately from the pinion gear 23 and the electromagnetic clutch is connected in parallel with the motor 18.

In order to open the slide door 1 automatically by the power of the motor from the outside of a vehicle, a key-operated lock-type outside door switch 30 is disposed on the outside of the vehicle body, for instance, in the center pillar 26 as shown in FIG. 1.

With reference to FIGS. 5, 6, 7 and 8, the structure of this outside door switch 30 is described hereinbelow in greater detail. This outside door switch 30 is key-operated cylindrical lock-type, which is roughly made up of a casing 31 fixed to the center pillar 26 and a cylindrical body 32 pivotably inserted into the casing 31. This switch 30 is provided with three switches: an outside door locking switch 33 for energizing the electromagnetic actuator 11, an outside door opening switch 36, and an outside door closing switch 37 for driving the motor 18.

The normally-closed switch 33 is closed when a key is not inserted into the cylindrical body 32 but opened when a key is inserted into the cylindrical body 32. The normally open switches 36, 37 are closed when a key is rotated clockwise or counterclockwise to the door-open position or the door-close position.

Figure 6:
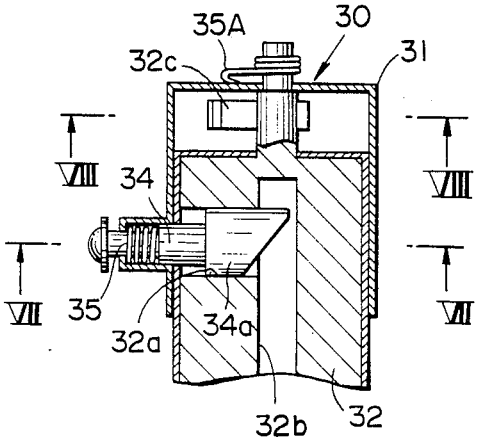
FIG. 6 is a cross-sectional view taken along the line VI—VI shown in FIG. 5.
Figure 7:
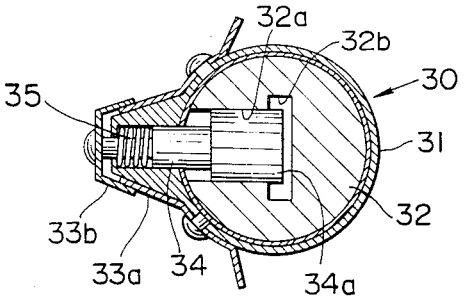
FIG. 7 is a cross-sectional view taken along the line VII—VII shown in FIG. 6.

The outside door locking switch 33 is mounted on the outer peripheral surface of the casing 31. This switch 33 includes a fixed contact 33*a* fixed to the casing 31 and a movable contact 33*b* attached to an operation pin 34 as depicted in FIG. 7. The operation pin 34 is formed with a slope-shaped cam portion 34*a* at one end thereof and housed within a recess 32*a* formed in the periphery of the cylindrical body 32 as depicted in FIG. 6. This operation pin 34 is urged by a spring 35 toward the inside of the cylindrical body 32 to normally close the switch 33. The cam portion 34*a* is disposed so as to reach a key insertion hole 32*b* formed at the center of the cylindrical body 32. Therefore, when a key (not shown) is inserted into the key insertion hole 32*b*, since the cam portion 34*a* of the operation pin 34 is moved toward the outside against the elastic force of the spring 35, the switch 33 is opened. When a key is extracted from the key hole 32*b*, the switch 33 is closed.

Figure 5:
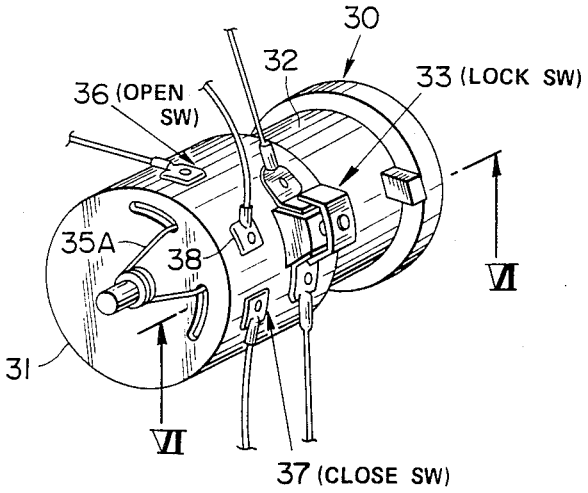
FIG. 5 is a perspective view of an embodiment of a key-operated cylindrical lock-type outside door switch used for the slide door opening/closing apparatus according to the present invention.

The cylindrical body 32 is set to a neutral position usually by a set spring 35A, but is rotatable clockwise or counterclockwise when a key inserted into the key hole 32*b* is rotated. However, as depicted in FIG. 5, the rotatable angular ranges are defined by the set spring 35A, because the bent end portions of the set spring 35A are inserted into two arcuate grooves, respectively.

The outside door opening and closing switches 36 and 37 include a movable contact 39 disposed on the outer peripheral surface of a fan-shaped rotor 32*c* attached to the one end portion of the cylindrical body 32, a fixed door open contact 36*a* and a fixed door close contact 37*a*, and a fixed neutral contact 38, the three fixed contacts 36*a*, 37*a* and 38 being all arranged on the casing 31.

Therefore, when the cylindrical body 32 is at the neutral position N, the movable contact 39 is in contact with only the fixed neutral contact 38, and therefore the door opening switch 36 and the door closing switch 37 are both opened. When the cylindrical body 32 is rotated clockwise, since the movable contact 39 is brought into contact with both of the fixed neutral contact 38 and the fixed door open contact 36*a* simultaneously, the switch 36 is closed in order to open the slide door 1 by driving the motor 18 in the normal direction. When the cylindrical body 32 is rotated counterclockwise, since the movable contact 39 is brought into contact with both of the fixed neutral contact 38 and the fixed door close contact 37*a* simultaneously, the switch 37 is closed in order to close the slide door 1 by driving the motor 18 in the reverse direction.

Figure 8:
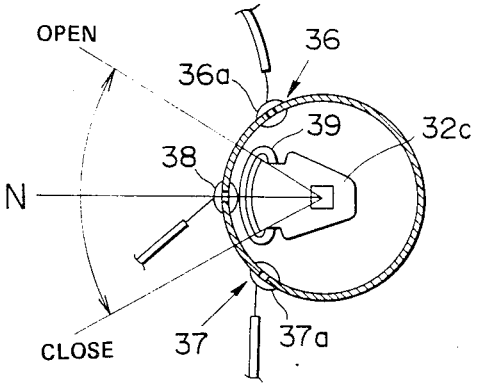
FIG. 8 is a cross-sectional view taken along the line VIII—VIII shown in FIG. 6.

Without providing the outside door opening and closing switches 36 and 37 as shown in FIG. 8, it is also possible to realize the same functions by providing switches which are turned on or off by a cam fixed to the cylindrical body 32. Further, the position where the outside door switch 30 is disposed is not limited to the outside portion of the center pillar.

Figure 9:
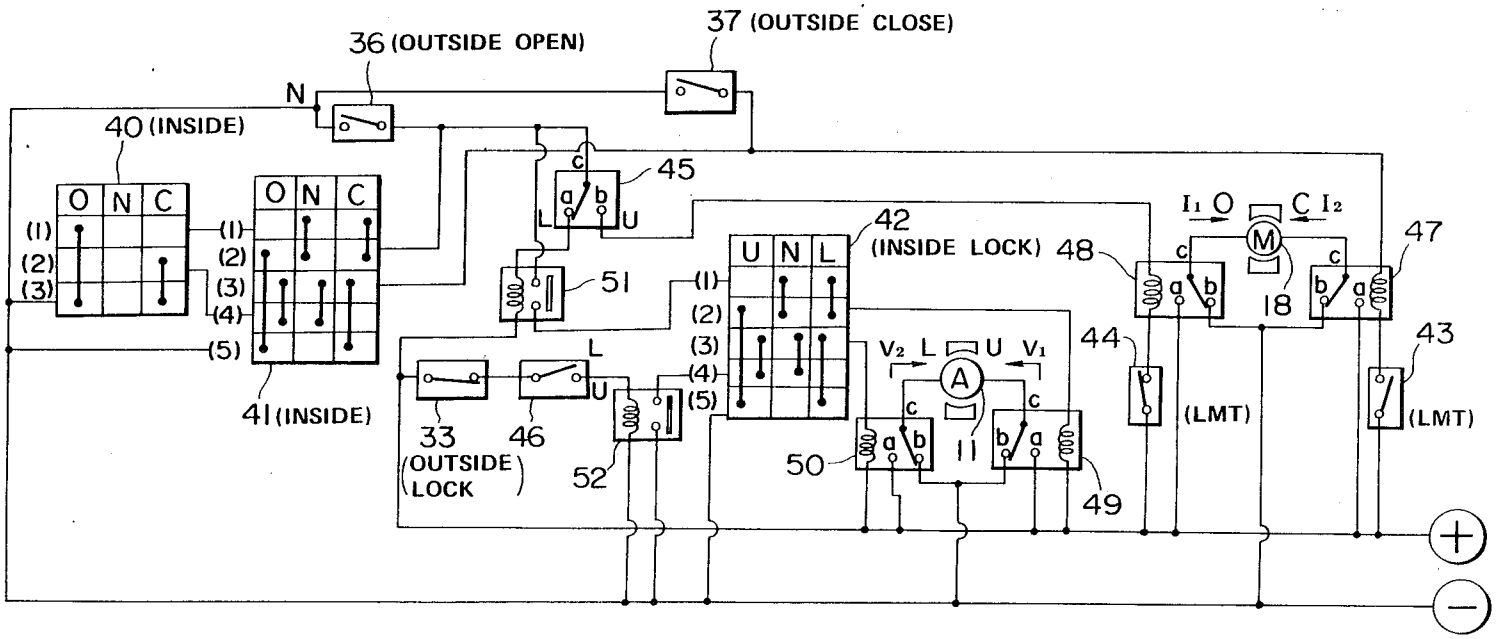
FIG. 9 is a schematic block diagram of the motor controlling circuit of the slide door opening/closing apparatus according to the present invention.

With reference to FIG. 9, the circuit configuration of the slide door opening/closing apparatus according to the present invention will be described hereinbelow.

The elements to be actuated are the motor 18 for driving the door opening/closing device shown in FIG. 2 and the electromagnetic actuator 11 for actuating the door locking/unlocking device shown in FIG. 1.

The circuit comprises roughly two driver-side and passenger-side door opening/closing switches 40 and 41, one driver-side door locking/unlocking switch 42, two door limit switches 43 and 44, two lock/unlock detection switches 45 and 46, and three outside switches (door locking switch 33, door opening switch 36 and door-closing switch 37) all arranged in the key-operated lock-type outside door switch 30.

The driver-side door opening/closing switch 40 is disposed near the driver seat within the passenger compartment in order to drive the motor 18, by which the driver can open or close the slide door from the inside of the vehicle. The passenger-side door opening/closing switch 41 is disposed near the rear passenger seat within the passenger compartment, by which the rear passenger can open or close the slide door from the inside of the vehicle. These two switches 40 and 41 are usually set to the Neutral position, but can be set to the Open position and Close position, respectively, when depressed.

The driver-side door locking/unlocking switch 42 is disposed near the driver seat within the passenger compartment in order to energize the electromagnetic actuator 11, by which the driver can lock or unlock the slide doors from the inside of the vehicle. This switch 42 is also set to Neutral position usually, but can be set to Lock position or Unlock position, respectively, when depressed.

The above-mentioned three switches 40, 41 and 42 are all shown in FIG. 9 in the form of squares, having three or five squares for each position of the switches. The solid line extending from one square to the other square indicates that the two squares are connected to each other when the switch is depressed at each of the three positions of Neutral, Open, and Close or Neutral, Lock, and Unlock.

The switch 43 is a door-close limit switch which is opened (turned off) when the slide door 1 is fully closed. The switch 44 is a door-open limit switch which is opened (turned off) when the slide door 1 is fully opened.

The switch 45 is a first lock/unlock detection switch disposed near the door locking/unlocking device 8, the movable contact c of which is brought into contact with a first fixed contact a when the slide door 1 is locked and into contact with a second fixed contact b when unlocked. The switch 46 is a second lock/unlock detection switch also disposed near the door locking/unlocking device 8, which is opened when the slide door 1 is locked and closed when unlocked.

The reference numerals 47 and 48 denote a door closing relay and a door opening relay, respectively, the movable contact c of each of which is in contact with a second fixed contact a, respectively, when energized. These relays 47 and 48 serve to switch the direction of current to be passed through the motor 18, that is, to drive the motor 18 in the normal or reverse direction.

The reference numerals 49 and 50 denote a door unlocking relay and door locking relay, respectively, the movable contact c of each of which is in contact with a second fixed contact b, respectively, when deenergized but brought into contact with a first fixed contact a, respectively, when energized.

These relays 49 and 50 serve to switch the direction of current to be passed through the electromagnetic actuator 11, that is, to drive the actuator 11 in the normal or reverse direction.

The reference numerals 51 and 52 denote a door unlock control relay and a door lock control relay, which are opened when deenergized but closed when energized.

Further, the first lock/unlock detection switch 45 is connected between the outside door opening switch 36 and the door opening relay 48 in order to energize the door unlocking relay 49, thereby unlocking the slide door before energizing the relay 48 which opens the slide door. This detection switch 45 serves to first unlock and next open the slide door when a key is inserted into the outside door switch 30 and rotated to its open position.

Furthermore, the second lock/unlock detection switch 46 is connected between the outside door locking switch 33 and the door locking relay 50 via the door lock control relay 52 for deenergizing the relay 50 after the relay 50 has been once energized to lock the slide door. This switch 46 serves to energize the relay momentarily when a key is extracted from the key-operated lock-type outside door switch 30.

The operation of the slide-door opening/closing apparatus according to the present invention will be described hereinbelow on the basis of the circuit shown in FIG. 9.

(I) When the slide door is opened from the inside of the vehicle:

(a) In the state where the door is closed and locked, when the driver depresses the driver-side door opening/closing switch 40 from Neutral to Open, the door unlock control relay 51 is first energized because current flows by way of (+), relay 51, 45-a, 45-c, 41-N-(2), 41-N-(1), 40-0-(1), 40-0-(3), and (−). Once the relay 51 is energized and therefore closed, the door unlocking relay 49 is energized because current flows by way of (+), relay 49, 42-N-(2), 42-N-(1), 51, 41-N-(2), 41-N-(1), 40-0-(1), 40-0-(3) and (−). Therefore, the movble contact c of the relay 49 is brought into contact with the first fixed contact a thereof. As a result, current flows through the actuator 11 in the direction $V_1$ by way of (+), 49-a, 49-c, actuator 11, 50-C, 50-b and (−), so that the actuator 11 is energized to unlock the door. Since the slide door is unlocked, the first lock/unlock detection switch 45 is switched to bring the movable contact c thereof into contact with the second fixed contact b thereof, so that the door opening relay 48 is next energized, because current flows by way of (+), 44 (the door is not yet fully opened), relay 48, 45-b, 45-c, 41-N-(2), 41-N-(1), 40-0-(1), 40-0-(3) and (−). When the relay 48 is energized, the movable contact c of the relay 48 is brought into contact with the first fixed contact a. As a result, current flows through the motor 18 in the direction $I_1$ by way of (+), 48-a, 48-c, motor 18, 47-c, 47-b, and (−) in order to rotate the motor in the normal direction. Therefore, the pinion 23 rotates along the rack 17 to open the slide door 1. When the door 1 is fully opened, since the door-open limit switch 44 is opened, the relay 48 is deenergized to return the movable contact c thereof to the second fixed contact b thereof, so that the two relays 47 and 48 are set as shown in FIG. 9. Since no current flows through the motor 18 and further the motor 18 is shorted by the two relays 47 and 48, the motor 18 stops rotating immediately after the door-open limit switch 44 has been opened.

In the above description, although the door close limit switch 43 is closed when the door is being opened, the door closing relay 47 is not energized, because no current flows therethrough or because current is disconnected from ground (−) at the switch 40.

(b) In the state where the door is closed and locked, when the rear passenger depresses the passenger side door opening/closing switch 41 from Neutral to Open, the door unlock control relay 51 is first energized because current flows by way of (+), 51, 45-a, 45-c, 41-0-(2), 45-0-(5) and (−). Once the relay 51 is energized and therefore closed, the door unlocking relay 59 is energized, because current flows by way of (+), 49, 42-N-(2), 42-N-(1), 51, 41-0-(2), 41-0-(5) and (−). Therefore, the movable contact c of the relay 49 is brought into contact with the first fixed contact a thereof. As a result, current flows through the actuator 11 in the direction $V_1$ by way of (+), 49-a, 49-c, actuator 11, 50-c, 50-b and (−), so that the actuator 11 is energized to unlock the door. Since the door is unlocked, the first lock/unlock detection switch 45 is switched to bring the movable contact c into contact with the second fixed contact b, so that the door opening relay 48 is next energized, because current flows by way of (+), 44 (the door is not yet fully opened), relay 48, 45-b, 45-c, 41-0-(2), 41-0-(5) and (−). The subsequent operation is quite the same as described in item I(a) above, the description thereof being omitted herein.

(II) When the slide door is closed from the inside of the vehicle:

(a) In the state where the door is opened and unlocked, when the driver depresses the driver-side door opening/closing switch 40 from Neutral to Close, the door closing relay 47 is directly energized because of the door-close limit switch 43 is closed and current flows by way of (+), 43, 47, 41-N-(3), 43-N-(4), 40-C-(2), 40-C-(3) and (−). Once the relay 47 is energized, the movable contact c thereof is brought into contact with the first fixed contact a. As a result, current flows through the motor 18 in the direction $I_2$ by way of (+), 47-a, 47-c, motor 18, 48-c, 48-b and (−) in order to rotate the motor 18 in the reverse direction. Therefore, the pinion 23 rotates reversely along the rack 17 to close the slide door 1. When the door is fully closed, since the switch 43 is opened, the relay 47 is deenergized to return the movable contact c thereof to the second fixed contact b thereof, so that the two relays 47 and 48 are set as shown in FIG. 9. Since no current flows through the motor 18 and further the motor 18 is shorted by the two relays 47 and 48, the motor 18 stops rotating immediately after the door-close limit switch 43 has been opened.

In the above description, although the door-open limit switch 44 is closed when the door is being closed, the door opening relay 48 is not energized, because no current flows therethrough or because current is disconnected from the ground (−) at the switch 40.

Under these conditions, the door movable contact 12 and the door fixed contact 13 shown in FIG. 1 are connected to apply a power supply voltage to the electromagnetic actuator 11.

Further, since the door locking switch 33 shown in FIG. 5 is kept closed (a key is not inserted into the key hole) and additionally the second lock-/unlock detection switch 46 is closed (door is not yet locked), the door lock control relay 52 first is energized and therefore closed because current flows from (+), 33, 46, relay 52 and (−). As a result, the door locking relay 50 is next energized to bring the movable contact c thereof into contact with the first fixed contact a thereof, because current flows by way of (+), relay 50, 42-N-(3), 42-N-(4), 52 and (−). Therefore, current flows through the actuator 11 in the direction $V_2$ by way of (+), 50-a, 50-c, actuator 11, 49-c, 49-b, and (−) in order to lock the door. Once the door locking/unlocking device 8 is locked, the detection switch 46 is opened; the relay 52 is deenergized; the relay 50 is deenergized into the original state as shown in FIG. 9. As a result, no current is supplied to the actuator 11. On the other hand, the first lock/unlock detection switch 45 is returned to the original state where the movable contact c thereof is brought into contact with the first fixed contact a thereof, because the door is locked.

(b) In the stae where the door is opened and unlocked, when the rear passenger depresses the passenger-side door opening/closing switch 41 from Neutral to Close, the door closing relay 47 is directly energized because the door-close limit switch 43 is closed and current flows by way of (+), 43, 47, 41-C-(3), 41-C-(5) and (−).

After the relay 47 has been energized, the door is locked in quite the same manner as in item II(a) above.

(III) When the slide door is unlocked from the inside of the vehicle:

In the state where the door is closed and locked, when the driver depresses the driver-side door locking/unlocking switch 42 from Neutral to Unlock, the door unlocking relay 49 is directly energized, because current flows by way of (+), reay 49, 42-U-(2), 42-U-(5) and (−). Once the relay 49 is energized, the movable contact thereof is brought into contact with the first fixed contact a thereof. Therefore, current flows through the actuator 11 in the direction $V_1$ by way of (+), 49-a, 49-c, actuator 11, 50-c, 50-b; and (−), so that the door locking-/unlocking device 8 is unlocked When the driver releases the switch 42 from the Unlock to Neutral, no current flows through the door unlocking relay 49, because the door unlock control relay 51 is kept deenergized, so that the two relays 49 and 50 are set as shown in FIG. 9. Since no current flows through the actuator 11, and further the actuator 11 is shorted by the two relays 49 and 50, the actuator 11 stops moving after the switch 42 has been released to its Neutral position.

After the door has been unlocked, the slide door can be opened manually by the use of the inside door handle 10 shown in FIG. 1 or automatically by the use of the driver-side or passenger-side door opening/closing switches 40 and 41.

(IV) When the slide door is locked from the inside of the vehicle:

(a) In the state where the door is closed, when the driver depresses the driver-side door locking/unlocking switch 42 from Neutral to Lock, the door locking relay 50 is directly energized because current flows by way of (+), 50, 42-L-(3), 42-L-(5) and (−). Once the relay 50 is energized, the movable contact c thereof is brought into contact with the first fixed contact a thereof. Therefore, current flows through the actuator 11 in the direction $V_2$ by way of (+), 50-a, 50-c, actuator 11, 49-c, 49-b and (−), so that the door locking mechanism 8 is locked.

When the driver releases the switch 42 from Lock to Neutral, no current flows through the relay 50, because the second lock/unlock detection switch 46 is opened (since the door is locked) and therefore the door lock control relay 52 is deenergized so that the two relays 49 and 50 are set as shown in FIG. 9. Since no current flows through the actuator 11, and further the actuator 11 is shorted by the two relays 49 and 50, the actuator 11 stops moving after the switch 42 has been released to its Neutral position.

(V) When the slide door is opened from the outside of the vehicle:

In the state where the door is closed and locked, when the driver inserts a key into the key insertion hole of the lock-type outside door switch 30, since the operation pin 34 (shown in FIGS. 6 and 7) is urged outward, the outside door locking switch 33 is opened. Further, when the driver rotates the key clockwise to Open position, the outside door opening switch 36 is closed. Therefore, the door unlock control relay 51 is energized because current flows by way of (+), 51, 45-a, 45-c, 36 and (−). Once the relay 51 is energized and therefore closed, the door unlocking relay 49 is energized, because current flows by way of (+), relay 49, 42-N-(2), 42-N-(1), 51, 36, and (−), so that the movable contact c of the relay 49 is brought into contact with the first fixed contact a thereof. Therefore, current flows through the actuator 11 in the direction $V_1$ by way of (+), 49-a, 49-c, actuator 11, 50-c, 50-b and (−), so that the actuator 11 is energized to unlock the door. Since the door is unlocked, the first lock/unlock detection switch 45 is switched to bring the movable contact c thereof into contact with the second fixed contact b thereof, so that the door opening relay 48 is energized, because current flows by way of (+), 44 (the door is not yet fully opened), relay 48, 45-b, 45-c, 36 and (−). When the relay 48 is energized, the movable contact c thereof is brought into contact with the first fixed contact a.

As a result, current flows through the motor 18 in the direction $I_1$ by way of (+), 48-a, 48-c, motor 18, 47-c, 47-b, and (−) in order to rotate the motor in the normal direction. Therefore, the pinion 23 rotates along the rack 17 to open the slide door 1. When the door 1 is fully opened, the door-open limit switch 44 is opened, the relay 48 is deenergized to return the movable contact c thereof to the second fixed contact b thereof, so that the two relays 47 and 48 are set as shown in FIG. 9. Since no current flows through the motor 18 and further the motor 18 is shorted by the two relays 47 and 48, the motor 18 stops rotating immediately after the switch 44 has been opened.

In the above description, although the door close limit switch 43 is closed when the door is being opened, the relay 47 is not energized because no current flows therethrough or because current is disconnected from the ground (−) at the outside door-closing switch 37 and the driver-side door opening/closing switch 40.

Further, it should be noted that the outside door-opening switch 36 is connected in parallel with the driver-side door opening/closing switch 40 or the passenger-side door opening/closing switch 41.

(VI) When the slide door is closed from the outside of the vehicle:

In the state where the door is opened and unlocked, when the driver inserts a key into the key insertion hole of the lock-type outside door switch 30 and rotates the key counterclockwise to close position, the outside door closing switch 37 is closed. Therefore, the door closing relay 47 is energized because current flows by way of (+), 43 (closed) 47, 37 and (−). Once the relay 47 is energized, the movable contact c thereof is brought into contact with the first fixed contact a thereof. As a result, current flows through the motor 18 in the direction $I_2$ by way of (+), 47-a, 47-c, motor 18, 48-c, 48-b, and (−) in order to rotate the motor 18 in the reverse direction. Therefore, the pinion 23 rotates reversely along the rack 17 to close the slide door 1. When the door is fully closed, the door-close limit switch 43 is opened, the relay 47 is deenergized to return the movable contact c thereof to the second fixed contact b thereof, so that the two relays 47 and 48 are set as shown in FIG. 9. Since no current flows through the motor 18 and further the motor 18 is shorted by the two relays 47 and 48, the motor 18 stops rotating immediately after the door-close limit switch 43 has been opened.

In the above description, although the door open limit switch 44 is closed when the door is being closed, the door opening relay 48 is not energized because no current flows therethrough or because current is disconnected from the ground (−) at the outside door-opening switch 36 and the driver-side door opening/closing switch 40.

Further, it should be noted that the outside door-closing switch 37 is also connected in parallel with the driver-side door opening/closing switch 40 or the passenger-side door opening/closing switch 41.

Thereafter, when the driver extracts the key from the outside door switch 30, since the operation pin 34 returns to the original state by the urging force of the set spring 35, the outside door locking switch 33 is closed again. Under these conditions, since the second lock/unlock detection switch 46 is closed (unlocked), the door lock control relay 52 is energized to close the contacts thereof because current flows by way of (+), 33, 46, 52 and (−). Therefore, the door locking relay 50 is also energized because current flows by way of (+), 50, 42-N-(3), 42-N-(4), 52 and (−). Therefore, the movable contact c of the relay 50 is brought into contact with the fixed contact a thereof. As a result, current flows through the actuator 11 in the direction $V_2$ by way of (+), 50-a, 50-c, actuator 11, 49-c, 49-b and (−), so that the door locking/unlocking device 8 is locked.

As described above, the slide door opening/closing apparatus for automotive vehicles according to the present invention has the following advantages: (1) the slide door can be opened or closed automatically from both the inside and the outside of the vehicle by the use of switches; (2) the slide door can be locked automatically after the door is fully closed and a key is extracted from the outside door switch, so that it is possible to prevent unlocking of the slide door due to the driver's carelessness.

Additionally, the slide door opening/closing device used with the apparatus according to the present invention has the following advantages: (1) the slide door can be opened or closed both manually or automatically, (2) no necessary parts are housed within the inside of the slide door without increasing the thickness of the door, (3) the wiring work and assembling work are simplified, and (4) since it is unnecessary to provide all the three guide rails (upper, lower, and waist), the device can be applicable to various types or models of automotive vehicles.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A slide door opening and closing apparatus for an automotive vehicle, which comprises:

(a) means for opening and closing a slide door;

(b) a motor for driving said slide door opening and closing means;

(c) an inside door switch means, disposed within a passenger compartment of the vehicle, for rotating said motor in the direction that said slide door opening and closing means opens and closes the slide door; and (d) a key-operated lock-type outside door switch means for locking the slide door, disposed in an outside position of the vehicle, and for rotating said motor in a first direction corresponding to the direction that said slide door opening and closing means opens the slide door when said outside door switch is rotated in a first direction and for rotating said motor in a second direction corresponding to the direction that said slide door opening and closing means closes the slide door when said outside door switch is rotated in a second direction.

2. A slide door opening and closing apparatus for an automotive vehicle, which comprises:

(a) means for opening and closing a slide door;

(b) a motor for driving said slide door opening and closing means;

(c) means for locking and unlocking the slide door;

(d) an actuator means for actuating said slide door locking and unlocking means;

(e) an inside door switch disposed within a passenger compartment of the vehicle for rotating said motor in the respective directions that said slide door opening and closing means opens and closes the slide door; and (f) a key-operated lock-type outside door switch means, disposed in an outside position of the vehicle, for energizing said actuator means, when a key is inserted thereinto, said actuator means actuating said slide door locking and unlocking means in the direction that the slide door is unlocked, and for energizing said actuator means when the key is extracted therefrom, said actuator means actuating said slide door locking and unlocking means in the direction that the slide door is locked, and for energizing said motor driving said slide door opening/closing means in the direction that the slide door is opened or closed, when the key is rotated.

3. A slide door opening and closing apparatus for an automotive vehicle, which comprises:

(a) means for opening and closing a slide door;

(b) a motor for driving said slide door opening and closing means;

(c) a door closing relay for connecting one terminal of said motor to a power supply when energizing and to ground when deenergized;

(d) a door opening relay for connecting another terminal of said motor to a power supply when energized and to ground when deenergized;

(e) a first inside door switch disposed within a passenger compartment of the vehicle comprising a first inside door opening switch connected to said door opening relay for energizing said door opening relay when closed and a first inside door closing switch connected to said door closing relay for energizing said door closing relay when closed; and (f) a key-operated lock-type outside door switch disposed in an outside position of the vehicle comprising an outside door opening switch connected in parallel with said first inside door opening switch and an outside door closing switch connected in parallel with said first inside door closing switch, said outside door opening switch and said outside door closing switch being closed when a key is rotated.

4. A slide door opening and closing apparatus for an automotive vehicle as set forth in claim 3, which further comprises:

(a) a door-close limit switch means, connected to said door closing relay, for deenergizing said door closing relay when the slide door is fully closed, said limit switch being opened when the slide door is fully closed; and (b) a door-open limit switch means, connected to said door opening relay, for deenergizing said door opening relay when the slide door is fully opened said limit switch being opened when the slide door is fully opened for deenergizing said door opening relay.

5. A slide door opening and closing apparatus for an automotive vehicle as set forth in claim 3, which further comprises a second inside door switch disposed within the passenger compartment of the vehicle and a second inside door opening switch connected in parallel with said first inside door opening switch of said first inside door switch and a second inside door closing switch connected in parallel with said first inside door closing switch of said first inside door switch.

6. A slide door opening and closing apparatus for an automotive vehicle as set forth in claim 3, wherein said means for opening and closing a slide door comprises:

(a) a guide rail fixed to vehicle body;

(b) a roller fixed to the slide door and slidably engaged with said guide rail;

(c) said motor being fixed to the slide door;

(d) a reduction gear mechanism connected to said motor;

(e) a pinion gear geared with said reduction gear mechanism;

(f) a rack fixed to said rail and geared wtih said pinion gear; and (g) a current collector for supplying power supply voltage to said motor slidably moving to and fro together with the slide door.

7. A slide door opening and closing aparatus for an automotive vehicle as set forth in claim 3, which further comprises:

(a) means for locking and unlocking the slide door;

(b) an actuator means for actuating said slide door locking and unlocking means;

(c) a door locking relay means for connecting one terminal of said actuator to power supply when energized and to ground when deenergized;

(d) a door unlocking relay means for connecting the other terminal of said actuator to power supply when energized and to ground when deenergized;

(e) an inside door locking and unlocking switch means, disposed within the passenger compartment of the vehicle and including an inside door locking switch connected to said door locking relay, for energizing said door locking relay when closed and an inside door unlocking switch means connected to said door unlocking relay, for energizing said door unlocking relay when closed; and (f) an outside door locking switch means disposed within said key-operated lock-type outside door switch and connected in parallel with said inside door locking switch means being closed when a key is extracted from said key-operated lock-type door switch.

8. A slide door opening and closing apparatus for an automotive vehicle as set forth in claim 7, which further comprises a first lock and unlock detection switch means, connected between said outside door opening switch and said door opening relay, for energizing said door unlocking relay to unlock the slide door before energizing said door opening relay to open the slide door, said slide door being first unlocked and then opened when a key is inserted and rotated to an open position.

9. A slide door opening and closing apparatus for an automotive vehicle as set forth in claim 7, which further comprises a second lock and unlock detection switch means, connected between said outside door locking switch and said door locking relay, for deenergizing said door locking relay after said door locking relay has locked the slide door, said slide door being first locked and then said door locking relay being kept deenergized when a key is extracted.

10. A slide door opening and closing apparatus for an automotive vehicle as set forth in claim 6, wherein said key-operated lock-type outside door switches comprises:

(a) a casing;

(b) a cylindrical body pivotably inserted into said casing and formed with a key insertion hole at the center thereof;

(c) an operation pin formed with a cam portion at the end thereof, said pin being disposed in a recess formed in said cylindrical body perpendicular to the longitudinal axis of said cylindrical body, said cam portion being disposed reaching the key insertion hole so as to be moved away from the longitudinal center of the cylindrical body when a key is brought into contact with the cam portion;

(d) an outside door-locking switch including a fixed contact fixed to the outer periphery of said casing and a movable contact attached to said operation pin, said door-locking switch being closed when no key is inserted into said key insertion hole but opened when a key is inserted into said key insertion hole; and (e) a pair of outside door closing/opening switch including an arcuate movable contact attached to said cylindrical body and three fixed neutral, open, close contacts each attached to the casing with an angular interval so that said arcuate movable contact can be in contact with neutral and open contacts or with neutral and close contacts simultaneously when a key inserted into the key insertion hole is rotated to either door open position or door close position.

* * * * *